US009768483B2

(12) United States Patent
Nawrocki

(10) Patent No.: US 9,768,483 B2
(45) Date of Patent: Sep. 19, 2017

(54) SIGNAL CABLE AND ITS APPLICATION

(71) Applicant: Piotr Nawrocki, Inowroclaw (PL)

(72) Inventor: Piotr Nawrocki, Inowroclaw (PL)

( * ) Notice: Subject to any disclaimer, the term of this patent is extended or adjusted under 35 U.S.C. 154(b) by 71 days.

(21) Appl. No.: 14/864,628

(22) Filed: Sep. 24, 2015

(65) Prior Publication Data

US 2017/0093006 A1 Mar. 30, 2017

(51) Int. Cl.
*H01P 3/08* (2006.01)
*H01P 3/02* (2006.01)

(52) U.S. Cl.
CPC ..... *H01P 3/02* (2013.01)

(58) Field of Classification Search
CPC ..... H01P 3/08; H01P 3/085; H01P 3/02
USPC ..... 333/1, 4, 5, 238
See application file for complete search history.

(56) References Cited

U.S. PATENT DOCUMENTS

2013/0248229 A1* 9/2013 Martens ..... H01B 1/02 174/255
2016/0380324 A1* 12/2016 Wu et al. ..... H01P 11/003 333/1

FOREIGN PATENT DOCUMENTS

| | | |
|---|---|---|
| CN | 103123830 A | 5/2013 |
| CN | 103811095 A | 5/2014 |
| CN | 203617133 U | 5/2014 |

* cited by examiner

*Primary Examiner* — Stephen E Jones
(74) *Attorney, Agent, or Firm* — Masuvalley & Partners

(57) ABSTRACT

The present invention is a signal cable for transmitting the signal between the transmitter and the receiver, providing an electrical connection by a connecting part, wherein said connecting portion comprises a layer of graphene disposed on a polymer layer, characterized in that it comprises two conductors, wherein each conductor includes a connecting portion arranged in a protective insulating layer (3) and the coupling portion takes the form of a tape, in which the graphene layer (1) is disposed between two polymer layers (2).

8 Claims, 3 Drawing Sheets

SIGNAL CABLE AND ITS APPLICATION

FIELD OF THE INVENTION

The present invention is related to a signal cable and its application.

BACKGROUND OF THE INVENTION

A signal cable is a cable for transferring high level input from an audio amplifier to a speaker or a loudspeaker. It is composed mainly of two wires insulated with plastic. It is most commonly described by the surface area of the conductor, as expressed in square millimeters, e.g. $2\times1.5$ mm$^2$, $2\times2.5$ mm$^2$, etc. The marking also uses the designation AWG unit. A cable with a larger diameter makes less resistance to the signal.

The invention relates to graphene connecting wires, especially for audio systems, for example, used to connect a turntable with preamplifier called interconnects in the audio industry and cables that connect a specific LF amplifier with a speaker system. These are crucial elements of a passive audio track.

Wires connecting the turntable preamplifier and cables connecting the amplifier with the speakers are a very important part of a sound track often giving an ungroomed character to the sound of music programs, music, and affect the unreadability of musical instrument sounds and speech. The use of poor quality cables clearly breaks or degrades readability, colour, understanding and sound quality. Cables and wires form a kind of transmission medium for acoustic waves of the whole spectrum of the sound spectrum bands connecting the amplifier with speakers. They are supposed to transfer both the signal of small amplitude and large amplitude to and from an audio amplifier to a speaker or a loudspeaker. Therefore, their quality is extremely important if for fidelity and quality of sound reproduction fed from the source to the amplifier, or for understanding, reading the information contained in the audio signal.

Speaker cables and interconnects are made up mostly of two electrical conductors insulated with plastic. An important parameter of interconnects and speaker cables is a cross-section of electrical cable, frequently described by the conductor surface area constructed of copper, expressed in square millimeters, for example $2\times0.5$ mm$^2$, $2\times1$ mm$^2$ (interconnects), $2\times1.5$ mm$^2$, $2\times2.5$ mm$^2$ (power cables), etc. A cable with a larger diameter makes less resistance to the signal which is favourable for direct impact on the power fed back into the speakers. Less power is dissipated in the transmission medium with a larger cross-section so more energy (power) arrives at the speakers. This is important information directly relating to users of audiophile tube power amplifiers in SE (Single End) configuration, whose output power is approx. 8, for amplifiers built on tubes, for example 300B, 2A3 and similar or transistor amplifiers working in the class A. with an output power not usually exceeding approx. 15 W.

Similar expectations apply to the cables connecting the turntable and the preamplifier. But in this case we do not use and do not have high power of the transmitted signal that are more resistant to external interference. On the contrary, in the interconnects we are dealing with small signals, where very high resistance is important and their susceptibility to interference reaching and besieging them from the outside negligible. When strengthening this type of signals minimal own medium, i.e. interconnects, noise is necessary and indeed indispensable. Unwanted own characteristics, though characteristic of each medium, will always be present, i.e. capacitance, inductance, resistivity, which have a direct impact on the spectrum and audio quality, or the quality of information, which is reinforced in subsequent stages audio system can affect the information.

The publication CN 103123830 A discloses a layered material, wherein the graphene is "located" between the insulating and conductive material in the form of two-dimensional monatomic or polyatomic structured layer. The insulating material proposed is, polyethylene, polyvinyl chloride, etc. And the conductive material proposed is copper, aluminum, silver or gold.

According to the publication CN 103123830 A the layered material is to be wound into a roll in order to obtain the desired effect, then one, two or more such rolls placed in a rubber tube to obtain cable for high voltages. The disadvantage of this is the use of precious metals as a conductive material, which increases the cost of the production of cables, as well as the necessity of rolling the roll, which is not convenient for the production of such cables and causes additional costs. The power cable known from CN 103123830 A is also not suitable as a signal cable for connecting audio, video or measurement devices.

Also the publication CN 203617033 U represents the utility model of cable for high voltages, which comprises several rollers in the middle, wherein each roll has a material containing a microchip with graphene uniformly dispersed in polyethylene. The diameter of the graphene microchips is not greater than 10 microns.

The publication CN 103811095 A discloses graphene cable comprising a metal core and a layer of graphene. The layer of graphene comprises from 1 to 10 layers of graphene deposited from vapour on a metal core. The metal core is made of copper, iron, aluminium or other metals, it may also be covered with another metal from the group: scandium, titanium, silver, chromium, manganese, iron, cobalt, nickel, copper, zinc, technetium, ruthenium, silver, cadmium, lutetium, hafnium, tantalum, tungsten, rhenium, osmium, iridium, molybdenum, gold, etc.

OBJECTS AND SUMMARY OF THE INVENTION

According to the invention the signal cable for transmitting the signal between the transmitter and the receiver, providing an electrical connection by a connecting part, wherein said connecting portion comprises a layer of graphene disposed on a polymer layer, characterised in that it comprises two conductors, wherein each conductor includes a connecting portion arranged in a protective insulating layer and the coupling portion takes the form of a tape, in which the graphene layer is disposed between two polymer layers.

Preferably, the two wires are connected together along one edge of the protective insulating layer.

Preferably graphene layer is in a two-dimensional form having a thickness of one atom or more than one atom or three dimensional and preferably they are nanotubes arranged in different directions, in particular parallel or perpendicular to the surface of the polymer.

Preferably, the polymer layer is a polymer selected from the group consisting of polyethylene terephthalate (PET), polyethylene naphthalate (TEN), polyethersulfone (PES), and polycarbonate (PC), polypropylene (PP), poly(ethylene oxide) (PEO), poly(vinyl chloride) (PVC), synthetic rubber, most preferably: polyethersulfone (PES), polycarbonate (PC).

Preferably, the protective layer is a layer with a very high resistance, preferably made of a material selected from the group including: Teflon, polyethylene terephthalate (PET), polypropylene (PP), poly(vinyl chloride) (PVC), synthetic rubber.

Preferably, the graphene is in its pure or doped form.

Preferably, each of the connectors includes plugs: the first plug for connecting a signal transmitter, and a second plug intended for connection to a signal receiver electrically connected by a connecting part.

The invention further encompasses the use of the signal cable to transmit the signal between the transmitter and the receiver.

BRIEF DESCRIPTION OF THE DRAWINGS

The invention will now be further described in the preferred embodiment, with reference to the accompanying drawings, in which.

DESCRIPTION OF EMBODIMENTS

Figure 1:
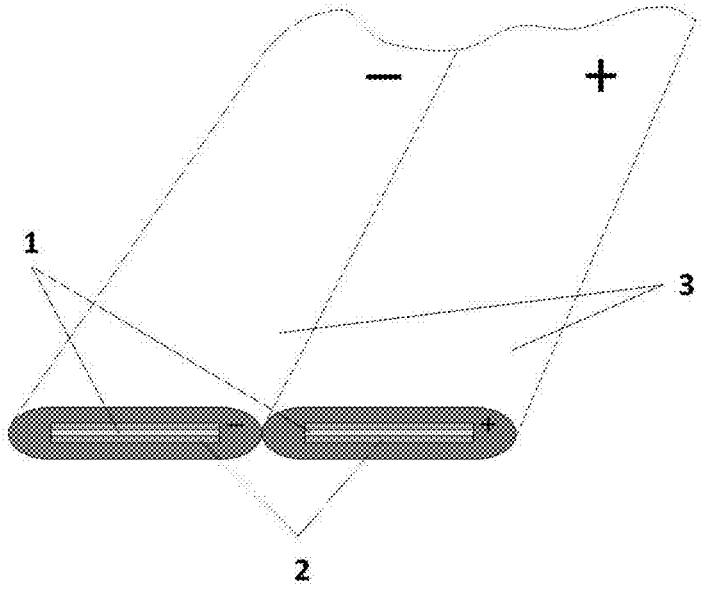
FIG. 1 shows a cross section of the interconnect (speaker wire) of the invention embodiment.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The figures use the following indications: 1—graphene; 2—polymer; 3—the protective layer, for example, Teflon; 4—preamplifier and amplifier; 5—signal source, e.g. DVD/CD player; 6—speakers.

The disclosed wires, both interconnects and speaker wires, contain a graphene layer 1 disposed between two polymer layers 2, which is not the signal carrier. The transmission medium is graphene.

Said polymer layer 2 is a polymer selected from the group consisting of polyethylene terephthalate (PET), polyethylene naphthalate (TEN), polyethersulfone (PES), and polycarbonate (PC), polypropylene (PP), poly(ethylene oxide) (PEO), poly(vinyl chloride) (PVC), synthetic rubber, most preferably: polyethersulfone (PES), polycarbonate (PC), which ensure its integrity, hardness, flexibility, resistance to compression.

Graphene layer 1, provides very good conductive properties while maintaining the transparency of the material. Interconnects (wires) are enclosed in a protective Teflon insulation layer 3 with a very high resistance, which is so inert that it does not affect the nature of the transmitted information. Graphene layer 1 is homogeneous and forms a surface characterised by a uniform level of electro-acoustic-wave propagation, which is audio signal composed in many ways. Accordingly, due to the fact that graphene has a two-dimensional structure (homogeneous) electrons move in one, or in a controlled plane (as free electrons) to either the front or the back (in copper as free electrons they move chaotically and in multi-dimensional structure). The cross-section of a medium for the transmission of sonic signals built on the basis of graphene is shown in FIG. 1.

Figure 2:
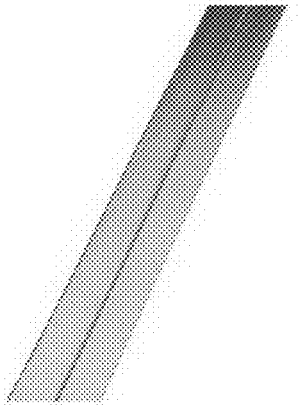
FIG. 2 shows the physical form of the medium on the basis of graphene to be used for interconnects.
Figure 3:
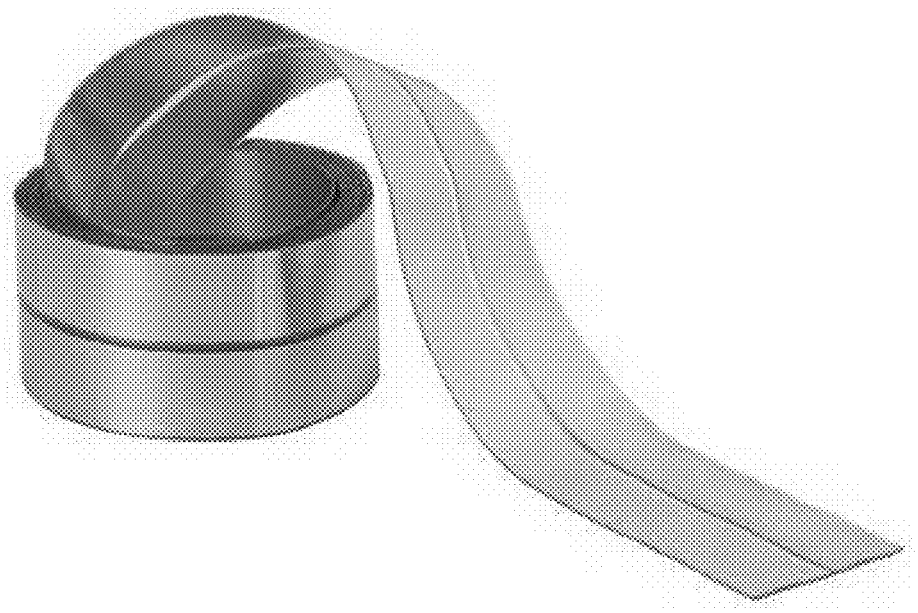
FIG. 3 shows the physical form of the medium on the basis of graphene to be used for speaker cables.

Cables built with graphene provide a high level of electroacoustic properties, which is a transmission medium of almost perfect characteristics. Reference signal, in this case, from the source 5 which is a turntable, a preamplifier, a power amplifier, seen as the output signal is matched in phase of the signal, the minimum power loss, a short propagation time, a short unit of time for transmission of energy of low-frequency to a load which are speakers, low noise floor, it is almost identical to the reference signal source. It is characterised by considerable indifference to inducing a spurious HF electromagnetic energy (High Frequency Energy) that passes through the presented cable in its various sections, and also has a resistance to RFI (Radio Frequency Interference) and EMI (Electro Magnetic Interference), which comes with a minimum capacity and inductance of the electrical structure of graphene. In addition, the presented passive elements of the audio track meet the requirements for mechanical strength. The physical form of a medium for the transmission of sonic signals built on the basis of graphene is shown in FIG. 2 and FIG. 3. FIG. 2 shows the physical form of the medium on the basis of graphene to be used for interconnects, and FIG. 3 shows the physical form of the medium on the basis of graphene to be used for speaker cables.

Commonly used speaker cables have sufficiently large cross-sections depending on the power of an audio amplifier, so as not to cause loss of power. The thinner the cross-section, the higher the resistivity, so more power loss hangs on the cable and less on the speaker terminals. Minimum wire cross-section (medium) connecting the amplifier with the speaker system should have a larger cross-section than the calculated one, but it should not be less. It should be mentioned here that an important determinant of minimum quality speaker cables is so called damping coefficient. It is an important parameter for electroacoustics laws given in the amplifier manual as Damping Factor (DF).

Figure 4:
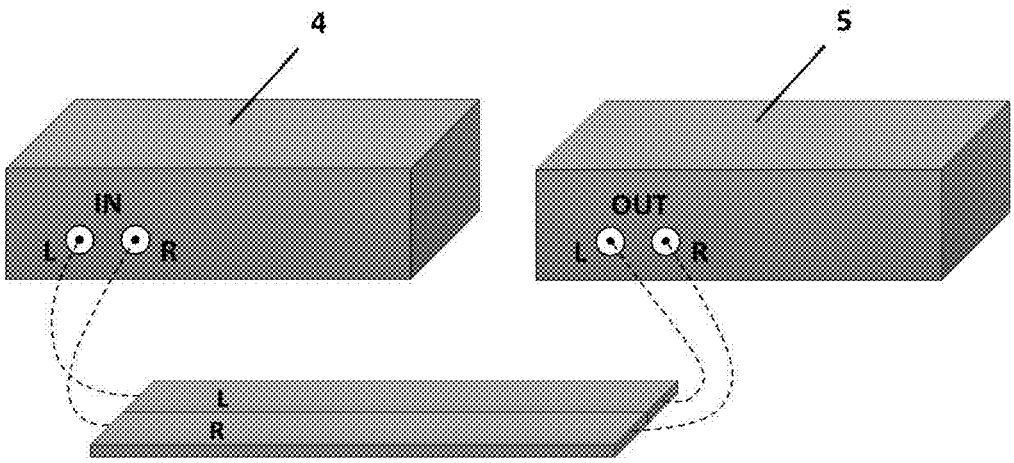
FIG. 4 shows the connection of sound sources with preamplifier and power amplifier.
Figure 5:
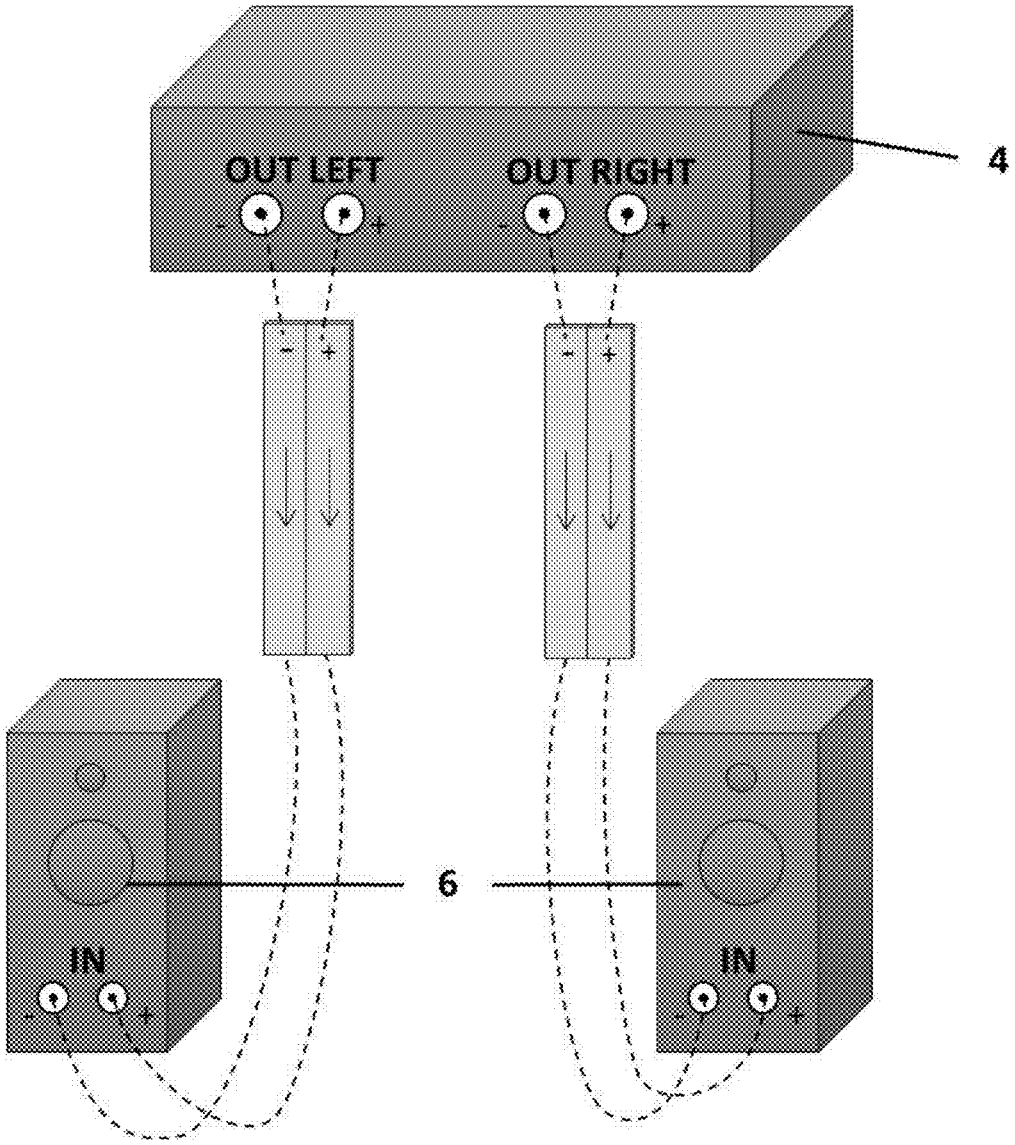
FIG. 5 shows the combination of an amplifier with loudspeaker system.

For the calculation of the minimum cross-section of a single conductor of a speaker cable, a definite damping coefficient for the entire system, amplifier, cables, speakers is assumed, but no more than given by the manufacturer of the amplifier (DF). Usually it is 200 (at 1 kHz for 8Ω load at 4Ω will be higher), although this value often increases at low frequencies and can even reach 1400. Assuming higher values of DF creates higher demands for the system for efficiency and, as one may guess, larger cross-sections of wires are used. These considerations apply to cables commonly used in audio equipment, as well as due to the relatively large parasitic phenomena relating to options other than graphene options. The connection of sound source 5 with preamplifier or amplifier 4 is shown in FIG. 4. In contrast, connection of amplifier 4 with a loudspeaker system 6 is shown in FIG. 5.

In the proposed solution there is no need to use thick, heavy cables, if with no loss of sonic qualities better, thinner, lighter, faster cables and interconnects can be used. The use of graphene cable to the speakers or loudspeaker also eliminates other problems with the speaker cables, which in the case of using a cable built based on graphene technology compared to technology based on, for example, copper almost does not exist, i.e. oscillations of the parasitic nature over acoustic.

Such oscillations can be clearly seen on the oscilloscope. Their symptom is usually unjustified heating of the amplifier heat sink, even with minimal input signal, and even in its absence due to the nature of the medium (inductance, capacitance, resistance). The formation of oscillations of a hum impact of SEM (strength of electromagnetic energy at a frequency of 50 Hz and harmonics) of high-field inductions in interconnects and audio cables. Oscillations can cause hyperactivity of the protection circuitry, resulting in malfunction of the amplifier. In the case of the use of these media active audio tracks can be minimized, so low pass filters in the amplifier degrading sound, bindings (twisting) of the conventional speaker cables brought out of the power amplifier or can be dispensed with. What affects the appearance of parasitic capacitance and lowering the frequency response of audio bandwidth thereby worsening the quality of sound reproduction.

It is well known that every element of the acoustic route and the design of preamplifiers and power systems, medium (transmission line) has an impact on the nature of sound quality SVM drive amplifier, and consequently speaker units. The type and quality of the components used to build audio transmission paths connecting the particular microphone preamplifiers, CD and DVD drives with power amplifiers and speaker systems have significant and not contestable influence on the character and quality of sound creation. In a situation where we use the media presented one has the impression that the character of the sound is created only by active elements. The transmission line—the presence of media on the basis of graphene in terms of acoustics is not felt. Transmission, reproduction and creation of sound occur by means of active audio track.

The use of interconnects and speaker cables constructed on the basis of graphene has a positive effect on the operation of individual degrees LF and significantly affects the quality and fidelity of sound reproduction by the system or audio device.

The present invention relates to transmission media, i.e. Interconnects and speaker cables made of graphene, which have the following characteristics:

- The vast flow velocity of electrons, about 1/300 the speed of light is the flow of electrons in the medium of graphene.
- They are characterised by substantial indifference to ubiquitous electromagnetic energy interference with low and high field intensity at high frequencies.
- Almost no formation of oscillations of a hum under the influence of electromagnetic energy at a frequency of 50 Hz and harmonics of high electromagnetic field intensity generated by long power cables, transformers, power supply circuits, etc.
- Very small capacitance, inductance and resistivity. Therefore, the said parameters minimally affect the sonic qualities of the audio systems working on graphene-based media.
- Very good mechanical strength and low weight compared to interconnects, cables built in technology based on, for example, copper, etc.
- Lack of parasitic excitation of audio sets of over-acoustic character present compared to cable interconnects constructed in technology based on copper.
- Lack of additional electromagnetic screens, which often in addition to improving these properties and performance degrade them and generate unnecessary costs.
- First and foremost they are characterised by pure, detailed, neutral, fully controlled sound reaching our consciousness, subconscious and superconscious.

The disclosed passive elements of the audio track can be used both in professional and commercial audio-video equipment. The disclosed transmission media are especially recommended to: electroacousticians, sound engineers and producers, musicians, music lovers, audiophiles, etc.

Interconnects can also be part of a larger whole, i.e. the microphone track, alone or being part of a mixer, console, including additional signal processors, such as, for example a noise gate, filters, dynamics compressors, parametric equalisers, limiters, and other types of equipment used in the audio art.

They can also act as media for connections: analogue, audio signals, mono, stereo, video signal, composite, RGB, aerial, digital connections, multi-channel, etc.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

The invention claimed is:

1. A signal cable for transmitting the signal between a transmitter and a receiver, providing an electrical connection by a connecting part, wherein said connecting part comprises a layer of graphene disposed on a polymer layer, characterised in that the signal cable comprises two conductors, wherein each conductor includes one of said connecting part arranged in a protective insulating layer and the connecting parts take the form of a tape, in which the graphene layer is disposed between the polymer layer and an additional polymer layer.

2. The signal cable of claim 1, characterised in that the two wires are connected together along one edge of the protective insulating layer.

3. The signal cable of claim 1, characterised in that the graphene layer is two-dimensional with a thickness of one atom or more than one atom or three dimensional and preferably they are nanotubes arranged in different directions, in particular parallel or perpendicular to the surface of the polymer.

4. The signal cable of claim 1, characterised in that the polymer layer is a polymer selected from the group consisting of polyethylene terephthalate (PET), polyethylene naphthalate (TEN), polyethersulfone (PES), and polycarbonate (PC), polypropylene (PP), poly(ethylene oxide) (PEO), poly (vinyl chloride) (PVC), synthetic rubber, most preferably: polyethersulfone (PES), polycarbonate (PC).

5. The signal cable of claim 1, characterised in that the protective layer is a layer with a very high resistance, preferably made of a material selected from the group including: polytetrafluoroethylene (PTFE), polyethylene terephthalate (PET), polypropylene (PP), poly(vinyl chloride) (PVC), synthetic rubber.

6. The signal cable of claim 1, characterised in that the graphene is in pure or doped form.

7. The signal cable according to claim 1, characterised in that each of the conductors has plugs: the first plug for connecting the signal transmitter, and a second plug intended for connection to the signal receiver electrically connected by a said connecting part.

8. Use of a signal cable according to claim 1 for signal transfer between the transmitter and the receiver.

* * * * *